US005191559A

United States Patent [19]

Kahn et al.

[11] Patent Number: 5,191,559

[45] Date of Patent: Mar. 2, 1993

[54] PIEZOELECTRIC CERAMIC HYDROSTATIC SOUND SENSOR

[75] Inventors: Manfred Kahn, Alexandria, Va.; Mark Chase, Laurel, Md.

[73] Assignee: The United States of America as represented by the Secretary of the Navy, Washington, D.C.

[21] Appl. No.: 622,658

[22] Filed: Dec. 5, 1990

[51] Int. Cl.[5] ..... H04R 17/00

[52] U.S. Cl. ..... 367/157; 367/160; 367/163; 310/334; 310/337; 29/25.35

[58] Field of Search ..... 367/157, 160, 167, 180, 367/163; 310/337, 334, 322; 264/59, 61; 29/25.35

[56] References Cited

U.S. PATENT DOCUMENTS

| | | | |
|---|---|---|---|
| 3,255,431 | 6/1966 | Howatt | 367/160 |
| 4,766,718 | 8/1988 | Utsumi et al. | 427/97 |
| 4,876,179 | 10/1989 | Bast et al. | 430/320 |
| 4,876,476 | 10/1989 | Kittaka et al. | 310/320 |

FOREIGN PATENT DOCUMENTS

| | | | |
|---|---|---|---|
| 750758 | 7/1980 | U.S.S.R. | 367/157 |

*Primary Examiner*—J. Woodrow Eldred
*Attorney, Agent, or Firm*—Thomas E. McDonnell; Barry A. Edelberg; John J. Karasek

[57] ABSTRACT

A piezoelectric ceramic hydrostatic sound sensor or transducer having high sensitivity to hydrostatic pressure is made by placing a flat plastic disc between two flat layers of green ceramic material, compressing and fusing the layers, heating to a first temperature at which the plastic decomposes, leaving a flat void in the ceramic, and heating to a second temperature at which the ceramic sinters. The transducer is provided with electrodes on its top and bottom surfaces. In a further improvement, ceramic particles are provided which are entrapped in the void; they render the sound sensor sensitive to inertial forces. In yet another improvement, the inside walls of the void are coated with a conductive noble metal connected to a terminal wire, whereby an additional electrode is provided for sensing the electromechanical response of the transducer.

16 Claims, 2 Drawing Sheets

PIEZOELECTRIC CERAMIC HYDROSTATIC SOUND SENSOR

BACKGROUND OF THE INVENTION

1. Field of Invention

This invention relates to a piezoelectric ceramic hydrostatic sound sensor or transducer having one or a plurality of voids and to a method for making such a transducer.

2. Description of the Prior Art

Conventional piezoelectric ceramic hydrophones employ relatively incompressible materials such as lead zirconate titanate (PZT) having the general formula $(PbO)(ZrO_2)_{0.52}(TiO_2)_{0.48}$; PZT doped with 6–15% lanthanum oxide, $La_2O_3$ (PZLT); barium titanate, $BaTiO_3$; lead zinc niobiate, $(PbO)(ZnO)(Nb_2O_5)$; and lead magnesium niobiate, $(PbO)(MgO)_{0.33}(Nb_2O_5)_{0.67}$; The electromechanical response of ceramic transducers to hydrostatic pressure variations is only a fraction of their uniaxial electromechanical sensitivity because, due to their Poisson ratio, the lateral force components due to hydrostatic pressure tend to cancel out the axial compression of the material, thereby reducing the electromechanical response to hydrostatic pressure.

Improvements in the electromechanical response of ceramic transducers to hydrostatic pressure have been achieved by the provision in the ceramic transducer of voids or pores. Randomly spaced voids provide some improvement in electromechanical response but tend to weaken the ceramic structure, making it susceptible to breaking. Regularly-spaced voids of uniform dimensions provide improved electromechanical response without the loss of mechanical strength and without increased susceptibility to breaking.

U.S. Pat. No. 4,683,161 provides ceramic bodies with ordered pores or voids and a method of making such ceramic bodies. The method employs thermally fugitive materials to create voids in the ceramic material.

U.S. Pat. No. 4,353,957 provides a method for forming monolithic ceramic capacitors having ceramic dielectric insulators. Thermally fugitive material is used to create voids in the ceramic. These are filled with metal to create capacitor plates.

U.S. Pat. No. 4,617,707 provides a method for manufacturing ultrasonic antenna arrays by laminating alternate layers of green ceramic and heat-fugitive filler material and subsequently removing such filler material by heating.

U.S. Pat. No. 4,753,964 provides a method of manufacturing a multilayered ceramic substrate having embedded and exposed conductores for mounting and interconnecting electronic components. A pattern of solid, nonporous conductors is attached to a backing sheet, transferred to a green ceramic sheet and sintered.

U.S. Pat. No. 4,806,295 provides a method of preparing ceramic monolithic structures with internal cavities and passageways by forming individual layers of ceramic by cutting and punching, stacking these layers and sintering.

U.S. Pat. No. 4,867,935 provides a method of preparing a dielectric ceramic composition containing hollow microspheres which can be cast on a substrate in the form of a tape or sheet for multilayer circuits.

U.S. Pat. No. 4,885,038 provides a method for producing multilayered ceramic structures having copper-based conductors therein.

SUMMARY OF THE INVENTION

It is the object of the present invention to provide a ceramic electromechanical transducer having one or several flat voids and a method for making such a transducer.

It is a further object of the present invention to provide a ceramic transducer having highly improved electromechanical sensitivity to hydrostatic pressure as well as inertia forces.

It is yet another object of this invention to provide an economical method for making such an improved electromechanical transducer.

This invention features a ceramic transducer body being essentially a flat plate or disc and having one or several flat void spaces therein oriented parallel to the major plane of the flat plate or disc. One void is preferred, but a plurality of voids uniformly spaced in one plane, or spaced parallel to each other in different, uniformly spaced planes, may also be used.

The flat void spaces are prepared by embedding between flat layers of the green ceramic material, 10 to 50 mm in diameter and 1.5 to 3 mm thick, flat plastic discs about 8 to 40 mm in diameter and 0.2 to 0.8 mm thick, compressing the stack of layers of green ceramic material so that the layers deform and come in contact around the periphery of the plastic disc or discs, heating the ceramic material to a first temperature at which the plastic discs decompose and their gaseous decomposition products escape from the ceramic body, leaving behind void spaces having the dimensions of the plastic discs, and further heating to a second temperature, whereby the ceramic material sinters into a mechanically strong structure.

The flat layers of green ceramic material, which contains a binder, may be prepared by casting a tape of ceramic material, or by pouring a layer of binder-coated ceramic powder into a die.

In a further improvement, particles of ceramic material are embedded in the plastic discs prior to heating and sintering as described above for making a ceramic transducer. These particles remain in the voids and render the transducer capable o providing an electromechanical response to inertial forces resulting from vibrations.

In yet another improvement, holes are drilled through a wall of the sintered transducer to provide access to the voids therein, and a liquid organic compound of a noble metal, such as a silver or gold salt of a carboxylic acid or an organic compound of platinum or palladium is introduced into the voids. The transducer is heated, whereby the liquid is decomposed and the noble metal is deposited on the walls of the void spaces. The noble metal coating is electrically connected through the holes to external transducer terminals.

BRIEF DESCRIPTION OF THE DRAWINGS

FIGS. 1, 2, and 4 illustrate the directions of the axial and radially directed force components in the transducer.

DETAILED DESCRIPTION OF THE PREFERRED EMBODIMENT(S)

A ceramic transducer according to this invention is made from lead zirconate titanate (PZT) having the general formula $(PbO)(ZrO_2)_{0.52}(TiO_2)_{0.48}$; PZT doped with 6–15% lanthanum oxide, $La_2O_3$ (PZLT); barium titanate, $BaTiO_3$; lead zinc niobiate, $(PbO)(ZnO)(Nb_2O_5)$; and lead magnesium niobiate, $(PbO)(MgO)_{0.33}(Nb_2O_5)_{0.67}$. A flat disc of a plastic, such as polymethylmethacrylate or polyvinyl acetate, having a diameter of about 8 to 40 mm and a thickness of about 0.2 to 0.8 mm, is inserted between two layers of green ceramic material each about 1.5 to 3 mm thick and about 10 mm to 50 mm in diameter, forming a type of sandwich, and the sandwich is compressed so as to deform the layers of green ceramic material and to bring them into contact with each other around the periphery of the plastic disc, causing some thermoplastic fusion to take place.

This sandwich is gradually heated for 5 to 10 hours, preferably about 8 hours, to about 200 to 300 degrees C., preferably about 260 degrees C., whereby the plastic disc decomposes, and a void space having the original dimensions of the plastic disc is left.

The structure is next heated to 1000 to 1300 degrees C., preferably about 1250 degrees C. for 15 to 30 minutes, preferably about 20 minutes, whereby the ceramic material sinters.

Electrodes 1 and 2 are then provided with silver-bearing paint applied to the top and bottom faces of the transducer and connected to terminal wires 3 and 4, and the transducer is poled at 130 degrees C. in an electric field of 3 kilovolts per millimeter for 6 minutes. The terminal wires are then connected to the input terminals of an amplifier for sensing the electrical output of the transducer.

The electromechanical response of this transducer to hydrostatic pressure, as expressed by the ratio of the voltage generated across the transducer terminals to the hydrostatic pressure applied, is at least ten times as great as that of a monolithic disc of the same ceramic material, the same physical dimensions, and having been similarly poled.

Figure 1:
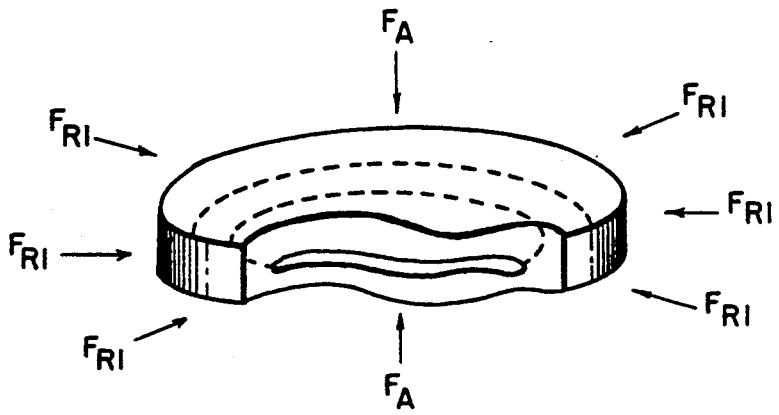
FIG. 1 is an isometric view of a ceramic transducer body having single flat void therein, the void being shown by a partial cutaway view.
Figure 2:
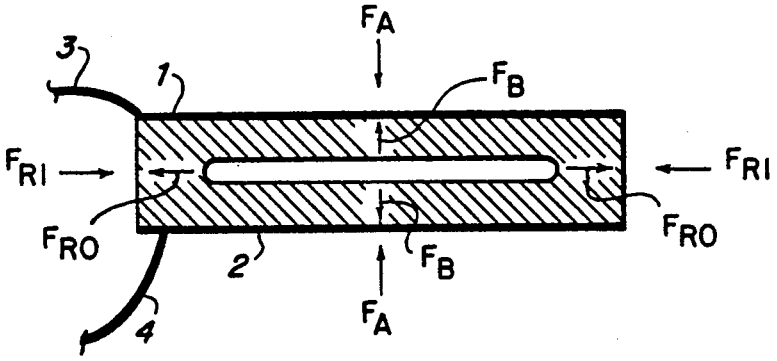
FIG. 2 is a cross sectional view of a ceramic transducer having a single void.
Figure 3:
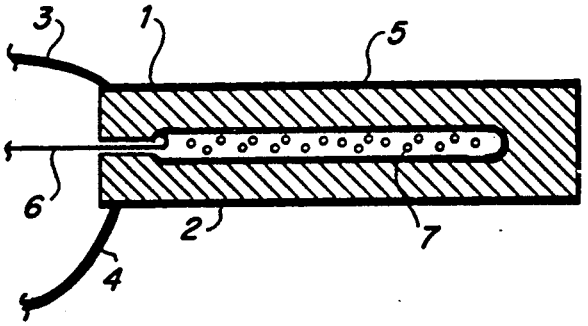
FIG. 3 is a cross sectional view of a ceramic transducer having a single void with conductive metal walls and small ceramic particles within the void.
Figure 4:
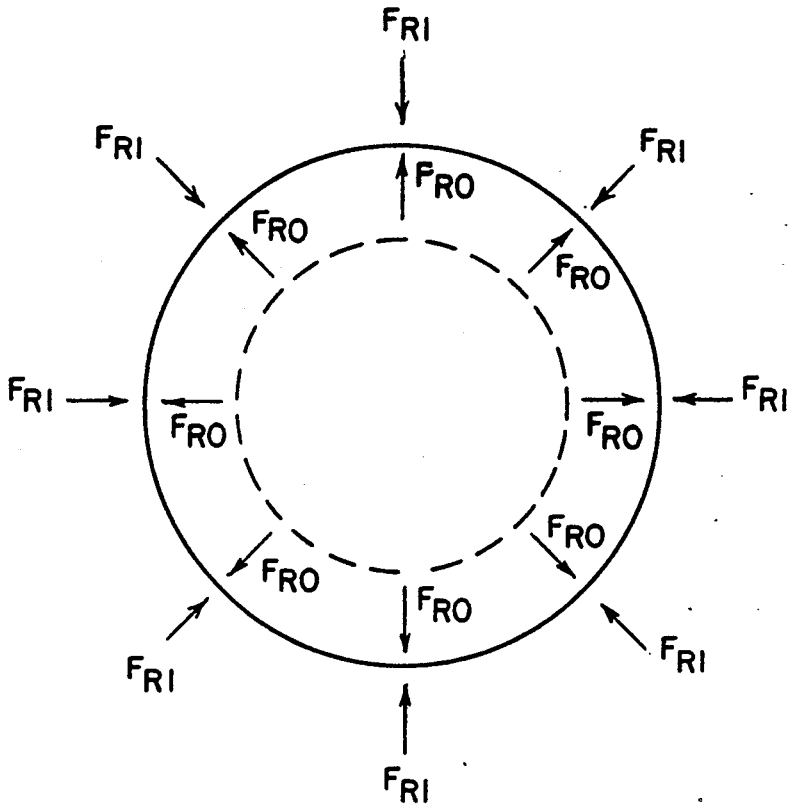
FIG. 4 is a plan view.

The improved electromechanical response of the transducer to hydrostatic pressure may be explained by a balance of mechanical forces as illustrated by FIGS. 1, 2, and 4. The axial forces component F due to the hydrostatic pressure tend to compress the transducer in an axial direction. In the absence of voids, this compression is partly canceled by an opposing outwardly directed axial force F caused by the radially inward forces F due to hydrostatic pressure and the Poisson ratio of the transducer material. With the flat void or voids, however, the lateral, inward force components are counterbalanced by radially outward forces resulting from lever action about the edges of void induced by the axial hydrostatic forces F.

As a further improvement, cast into the plastic disc are particles 7 of ceramic, 25 to 100 microns in diameter, preferably piezoelectric and similar or identical in composition to that of the transducer, and the transducer is made as described above. After heating, the ceramic particles end up trapped in the voids in the transducer. A slight mechanical shock loosens them from the walls of the void, so that they then are free to move within the void in response to acceleration or inertial forces such as are caused by vibrations. Because of their small size, the particles can respond to higher frequencies than conventional, more massive accelerometer elements. When the transducer vibrates at high frequencies, the impact of the particles on the void walls are sensed by the piezoelectric ceramic walls of the transducer.

As yet another improvement, 0.5 to 1 mm diameter holes, one for each void, are drilled into the transducer from the edge of the transducer disc so as to provide access to the voids in the transducer. An organometallic silver or gold compound, such as a silver or gold salt of a carboxylic acid such as decanoic acid or 2-ethyl hexanoic acid, or palladium II acetate or acetylacetonate, or platinum II acetylacetonate, is introduced through these holes by vacuum impregnation so as to fill the voids, and the transducer is heated to 500 to 1000 degrees C., preferably about 750 degrees C., for from 10 to 20 minutes, preferably about 15 minutes, whereby the silver, gold, palladium or platinum compound decomposes and metallic silver, gold, palladium or platinum is deposited on the walls of the voids. The noble metal coatings 5 on the walls of the voids are connected to terminal wires 6 passing through the holes. These wires in combination with the terminal wires connected to the top and bottom electrodes of the transducer, allow the application of a poling voltage. These wires are then connected to the input terminals of an amplifier for sensing the electrical output of the transducer in response to hydrostatic pressure and to vibrations. For measuring hydrostatic pressure, the wires 3 and 4 are connected to the input of an amplifier. For measuring vibrations, wires 3 and 4 are grounded and wire 6 is connected to the input terminal of the amplifier. Alternatively, wire 6 is grounded and wires 3 and 4 are connected to the amplifier input terminal. These signals provide information on the instantaneous direction of the vibration vector.

Having described the invention, the following examples are given to illustrate specific applications of the invention including the best mode now known to perform the invention. These specific examples are not intended to limit the scope of the invention described in this application.

EXAMPLES

Example 1

A ceramic disc containing a flat, completely embedded void is prepared from a piezoelectric powder that contains lead oxide, zirconia and titania to which about 3% of a polyvinyl alcohol is added. Polymethyl methacrylate (PMM) is dissolved in toluene and is cast into a dried sheet 0.35 mm thick. Discs 15 mm in diameter are then punched from the sheet.

A 23 mm diameter die is then filled with about 1.5 mm of powder, the disc is placed and centered on it, and another 1.5 mm of powder are poured into the die over the centered disc. The resulting sandwich is then compressed at 40 MPa into a green pellet having about 45% porosity. This pellet is gradually heated over a period of 8 hours to 250° C. and then heated over a period of 5 hours to 1240° C. and held at that temperature for 20 minutes.

After the disc has cooled, silver electrodes are applied to the major surfaces of the disc. The disc is then inserted in a holding fixture that has appropriate contacts and immersed into an insulating oil heated to 130° C. A DC field of 3 kV/mm is then applied for 6 minutes. The resulting disc has a $d_h$ above 50 pC/N and a dielectric constant below 500.

Example 2

A slurry is made containing about 60% of piezoelectric powder, 10% of an acrylic binder and 30% of a solvent. This slurry is cast into a sheet ¼ mm thick and a stack is made from a plastic (PMM) disc as described above, embedded in between two stacks of eight tape sheets each. The assembly is then heated to about 120° C. and compressed at 17 MPa into a solid block. This solid block is then processed in a way similar to the pressed disc discussed above.

Example 3

This example is made similarly to the method described in Example 1, except that a 25 micrometer average diameter piezoelectric powder, weighing about 30% of the weight of the PMM is added to the PMM solution before it is dried. The resulting material is then included in the pressed sandwich and leaves a loose powder in the void after the ceramic is fired.

While there have been described what are at present considered to be the preferred embodiments of the invention, it will be obvious to those skilled in the art that various changes and modifications may be made therein without departing from the invention and it is therefore intended to cover all such modifications and changes as fall within the spirit and scope of the invention.

What is claimed is:

1. A piezoelectric ceramic hydrostatic sound sensor comprising an essentially flat plate-shaped monolithic body of ceramic material defining a plane, said body including upper and lower faces, a single essentially flat void therein essentially parallel to the plane of the body, said void being surrounded by said ceramic material, and electrodes attached to the upper and lower faces of the body.

2. A piezoelectric ceramic hydrostatic sound sensor according to claim 1 wherein the ceramic is made of a material selected from the group consisting of lead zirconate titanate (PZT) having the general formula $(PbO)(ZrO_2)_{0.52}(TiO_2)_{0.48}$; PZT doped with 6–15% lanthanum oxide, $La_2O_3$ (PZLT); barium titanate, $BaTiO_3$; lead zinc niobiate, $(PbO)(ZnO)(Nb_2O_5)$; and lead magnesium niobiate, $(PbO)(MgO)_{0.33}(Nb_2O_5)_{0.67}$.

3. A piezoelectric ceramic hydrostatic sound sensor according to claim 1 having a diameter of about 10 to 50 mm, a thickness of about 1.5 to 3 mm, and wherein said essentially flat void has a diameter from about 8 to about 40 mm and a thickness of about 0.2 to 0.8 mm.

4. A piezoelectric ceramic hydrostatic sound sensor comprising an essentially flat plate-shaped body defining a plane, said body including upper and lower faces, an essentially flat void therein essentially parallel to the plane of the body, electrodes attached to the upper and lower faces of the body and freely movable particles of ceramic material within the void.

5. A piezoelectric ceramic hydrostatic sound sensor according to claim 1 further comprising a conductive metal coating on the walls of the void.

6. A piezoelectric ceramic hydrostatic sound sensor according to claim 5 wherein the conductive metal is selected from the group consisting of silver, gold, palladium and platinum.

7. The sensor of claim 1, further comprising electrical terminal wires connected to said electrodes for transmitting an electrical voltage output in response to hydrostatic pressure.

8. The sensor of claim 1, wherein said void is dimensioned to counterbalance radially outward forces resulting from lever action about edges of said void when axial hydrostatic forces axially compress said sensor.

9. A piezoelectric ceramic hydrostatic sound sensor according to claim 4, wherein the ceramic is made of a material selected from the group consisting of lead zirconate titanate (PZT) having the general formula $(PbO)(ZrO_2)_{0.52}(TiO_2)_{0.48}$; PZT doped with 6–15% lanthanum oxide, $La_2O_3$ (PZLT); barium titanate, $BaTiO_3$; lead zinc niobiate, $(PbO)(ZnO)(Nb_2O_5)$; and lead magnesium niobiate, $(PbO)(MgO)_{0.33}(Nb_2O_5)_{0.67}$.

10. A piezoelectric ceramic hydrostatic sound sensor according to claim 4, having a diameter of about 10 to 50 mm, a thickness of about 1.5 to 3 mm, and wherein said essentially flat void has a diameter from about 8 to about 40 mm and a thickness of about 0.2 to 0.8 mm.

11. A piezoelectric ceramic hydrostatic sound sensor according to claim 4, further comprising a conductive metal coating on the walls of the void, said conductive metal coating being electrically connected to a terminal wire.

12. A piezoelectric ceramic hydrostatic sound sensor according to claim 11, wherein the conductive metal is selected from the group consisting of silver, gold, palladium and platinum.

13. A piezoelectric ceramic hydrostatic sound sensor according to claim 4, further comprising electrical terminal wires connected to said electrodes for transmitting an electrical voltage output in response to hydrostatic pressure.

14. A piezoelectric ceramic hydrostatic sound sensor according to claim 4, wherein said void is dimensioned to counterbalance radially outward forces resulting from lever action about edges of said void when axial hydrostatic forces axially compress said sensor.

15. A piezoelectric ceramic hydrostatic sound sensor according to claim 5, wherein said conductive metal coating is electrically connected to a terminal wire.

16. A piezoelectric ceramic hydrostatic sound sensor according to claim 1 wherein the diameter of said essentially flat plate-shaped monolithic body.

* * * * *